US008384270B2

(12) United States Patent
Huang et al.

(10) Patent No.: US 8,384,270 B2
(45) Date of Patent: Feb. 26, 2013

(54) PRESSURE-BALANCED ELECTROMECHANICAL CONVERTER

(75) Inventors: Songming Huang, Hardwick (GB); Franck Monmont, Highfields Caldecote (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 505 days.

(21) Appl. No.: 12/441,636

(22) PCT Filed: Jun. 25, 2007

(86) PCT No.: PCT/GB2007/002362
§ 371 (c)(1), (2), (4) Date: Jul. 24, 2009

(87) PCT Pub. No.: WO2008/035025
PCT Pub. Date: Mar. 27, 2008

(65) Prior Publication Data

US 2010/0000820 A1 Jan. 7, 2010

(30) Foreign Application Priority Data

Sep. 19, 2006 (GB) ..... 0618305.7

(51) Int. Cl.
*G10K 11/04* (2006.01)

(52) U.S. Cl. ..... 310/328; 310/324; 181/200

(58) Field of Classification Search ..... 310/328, 310/324; 181/200
See application file for complete search history.

(56) References Cited

U.S. PATENT DOCUMENTS

| | | | | |
|---|---|---|---|---|
| 3,489,995 | A * | 1/1970 | Laurent | 367/174 |
| 4,215,426 | A | 7/1980 | Klatt | |
| 4,515,225 | A | 5/1985 | Dailey | |
| 6,717,283 | B2 | 4/2004 | Skinner et al. | |
| 7,990,282 | B2 | 8/2011 | Huang et al. | |
| 8,009,059 | B2 | 8/2011 | Huang et al. | |
| 2003/0086337 | A1 * | 5/2003 | Constantinou et al. | 367/167 |
| 2004/0042915 | A1 * | 3/2004 | Rife et al. | 417/321 |
| 2004/0194947 | A1 * | 10/2004 | Ito et al. | 165/203 |
| 2005/0168349 | A1 * | 8/2005 | Huang et al. | 340/854.3 |
| 2005/0173185 | A1 * | 8/2005 | Pabon et al. | 181/108 |
| 2007/0194947 | A1 * | 8/2007 | Huang et al. | 340/854.3 |
| 2007/0227776 | A1 * | 10/2007 | Huang et al. | 175/42 |

FOREIGN PATENT DOCUMENTS

| | | |
|---|---|---|
| FR | 1556971 | 2/1969 |
| GB | 2405725 A | 3/2005 |
| GB | 2411676 A | 9/2005 |
| WO | 2005024177 A1 | 3/2005 |
| WO | 2005024182 A1 | 3/2005 |

* cited by examiner

*Primary Examiner* — Walter Benson
*Assistant Examiner* — Bryan Gordon

(57) ABSTRACT

A pressure-balanced electromechanical converter is described including a structure that converts displacement into electrical energy or electrical energy into displacement, said structure designed to separate an enclosed volume for an outside pressure wave channel, wherein said enclosed volume has a filtering pressure transparent connection to said outside pressure wave channel with said filtering connection be pressure transparent to static pressure or low frequency pressure waves and filtering pressure waves at higher frequencies.

12 Claims, 7 Drawing Sheets

PRESSURE-BALANCED ELECTROMECHANICAL CONVERTER

The present invention relates to electromechanical converters or transducers for use as either generator of electrical energy from an acoustic wave or as an acoustic or pressure wave generator, being in both variants exposed to a medium of high background pressure. The invention relates more specifically to such converters or transducers having dimensions sufficiently small for use in downhole installations.

BACKGROUND OF THE INVENTION

In oil field applications, it is often necessary to convert energy conveyed on a pressure wave into electrical energy or to generate a pressure wave signal for communication purposes, in both cases under a high background pressure. In such applications, there exists a pressure wave channel, for instance a part of a wellbore filled with fluid, through which energy in the form of a pressure change or pressure wave can be transmitted from one part of the well to other parts of the well. Such pressure waves are often also referred to as acoustic waves.

In a conventional downhole pressure sensor, the sensing element, such as a capsule or a membrane has one side exposed to the pressure to be measured and the other side to a reference pressure, typically a vacuum. The stiffness of the sensing element increases with the pressure range to ensure that the structure does not collapse. The sensitivity of the device is therefore traded off for the pressure range.

For the pressure wave powered downhole electricity generator described in the published international patent application WO 2005/024177 A1, a multilayer piezoelectric ceramic stack, or a solid TERFENOL-D rod, is proposed as the mechanical to electrical energy converter. The main reason for choosing such solid body structures is that they will survive the high-pressure environment.

However, a conversion device based on such a structure can show a poor efficiency in acoustic to electrical energy conversion for several reasons. Firstly, the acoustic impedance of a solid body device is much higher than that of the fluid filled pressure wave channel through which the pressure is applied to the energy converter. Therefore, much of the acoustic energy is reflected away from the fluid/solid interface. Secondly, the strain of the solid body caused by a pressure wave of limited amplitude is very small and thus limiting the magnitude of electrical charge or current generated, which is typically proportional to the strain.

Other devices adapted for a downhole pressure/acoustic wave signal generation are described for example in the published international patent application WO 2005/024182 A1. In that document a pressure wave generator is described based on a multilayer piezoelectric ceramic stack. The generator is suitable for high-pressure environments. However, due to the impedance mismatch between the solid stack and the fluid in the pressure wave channel at the proposed operating frequency, i.e. a few tens Hertz, energy is not always efficiently transmitted into the medium.

A complete system to be used for either downhole power generation or downhole communication will include pressure wave sources that generate the wave from electrical power, and receivers that convert the pressure wave or acoustic energy into an electrical one. An example of a receiver is a pressure wave powered downhole electricity generator as proposed in WO 2005/024177 A1, where the acoustic energy, carried by a low frequency (e.g. 20 Hz) pressure wave generated on surface, is converted into electricity that is used in turn to power downhole electronics.

To produce electricity efficiently from a low frequency pressure wave in a liquid channel, a compliant mechanical structure is needed to convert the pressure first into a strain of sufficient magnitude, which can then be converted into electricity by a strain-to-electricity converter. However in such an application, the downhole steady state pressure is typically in the order of several hundred bars, yet the amplitude of the pressure wave is likely to be in the order of one bar or below. It is therefore a challenge to design a structure that can survive the high background pressure while is still sufficiently compliant to generate the required strain level in response to moderate pressure changes.

There are other examples of converting a small dynamic pressure in a high steady state pressure background. For instance in a conventional measurement-while-drilling operation, mud pulse signals are detected by transducers mounted on a surface stand-pipe. The stand-pipe pressure is typically more than 1000 psi whereas the signal amplitude can be less than 1 psi. Therefore the requirement for the resolution and signal/noise ratio of the detection transducer is very high. In order to withstand the high background pressure, the sensing mechanical membrane of the transducer has to be made sufficiently stiff. The high stiffness, however, can reduce the transducer's sensitivity.

In applications where acoustic communication between downhole devices through the borehole is required, it is essential to have an acoustic source that can deliver sufficient acoustic power at a specified frequency. Since such a source is most likely to be powered by battery or by a downhole energy harvesting system, the efficiency of the source is an important issue.

In systems using for example a sensor plugged into the wall of a borehole some distance away from a cabled section of a well completion as recently proposed, the sensor transmits the measurement data to the cabled section via an acoustic signal. In order to produce a coherent signal for easy detection, it is essential to generate a planar wave propagation mode in the borehole. This means that the carrier wave frequency is preferably low, for example less than 1 kHz.

To generate such a low frequency wave efficiently, a source with sufficiently large cross-sectional area or large displacement is usually needed. A comparison with known sonar transmitters for low frequency underwater communications can show how large such a source would be following conventional designs. At a few kilohertz, the diameter of such a sonar is typically larger than 3 inches [8 cm].

For deployment in the confined space of a borehole, such a large source would be incompatible for many applications including the proposed sensor plug, whose small physical dimensions are its most advantageous feature.

In summary, in the applications discussed above, a dilemma exists between the need for a strong structure to stand high background pressure and that of a compliant one in order to produce sufficient strain. Therefore it remains an object to develop a compact yet efficient downhole sources for sub-kilohertz frequencies.

SUMMARY OF THE INVENTION

This invention describes a pressure balance method and a mechanical/acoustic system that converts dynamic pressure signals efficiently into mechanical strain in high steady-state pressure environment. The same system also facilitates an efficient pressure wave generator that can be used under high steady-state pressure. This technique can be applied in the form of dynamic pressure sensors, acoustic to electrical power converters and pressure wave or acoustic sources, where the high background pressure environment renders existing systems inefficient.

The mechanical-to-electrical or electrical-to-mechanical converter based on this invention has preferably a mechanical amplifier that has a compliant mechanical structure. With such a structure, small pressure change is amplified into significant mechanical strain. By pressure balancing the pressure side and the reference side of the structure in the near dc or zero frequency region, the effect of the background pressure is cancelled out. Only the dynamic component of the pressure is applied across the structure.

By creating a low mechanical/acoustic impedance on the reference side around the operating frequency, the structure can displace towards the reference side without much resistance, and significant mechanical strain can thus be generated. The efficiency of the converter is therefore improved as a result of better impedance match between the converter and the channel fluid.

In a preferred embodiment the converter comprises a filtering, pressure transparent connection with at least to acoustic impedance elements. In the case of just two of such elements, the first is designed to connect the pressure in the outer pressure wave channel with the input of the second impedance element, thereby connecting a frequency filtered output to a reference volume enclosed by the pressure conversion structure. The second end of the second impedance is preferably the acoustic ground and can thus be formed by any substantial solid mass.

Preferably the value of first impedance is zero or near zero at low frequencies around zero Hertz and it increases significantly as the frequency increases. The value of the second impedance is then designed to be significantly higher that that of the first impedance at low frequencies around zero hertz and it decreases significantly as the frequency increases.

In the interested operating frequency range, the value of the second impedance is preferably made to approach zero and that of the first impedance is significantly higher than that of the second impedance.

In a particularly preferred embodiment of the invention the first impedance includes a capillary. In an even more preferred embodiment of the invention, the second impedance includes a Helmholtz resonator or a fluid reservoir. The volume of reservoir is preferable made to be the largest part of the volume enclosed by the pressure conversion structure.

BRIEF DESCRIPTION OF THE DRAWINGS

The present invention will become more fully understood from the detailed description and the accompanying drawings, wherein.

DETAILED DESCRIPTION

In the following description, for the purposes of explanation, the background technologies, a basic example this invention and various preferred embodiments of the basic example are set forth in order to provide a thorough understanding of the invention. However, it will be apparent that the invention may be practiced without these specific details.

Figure 1A:
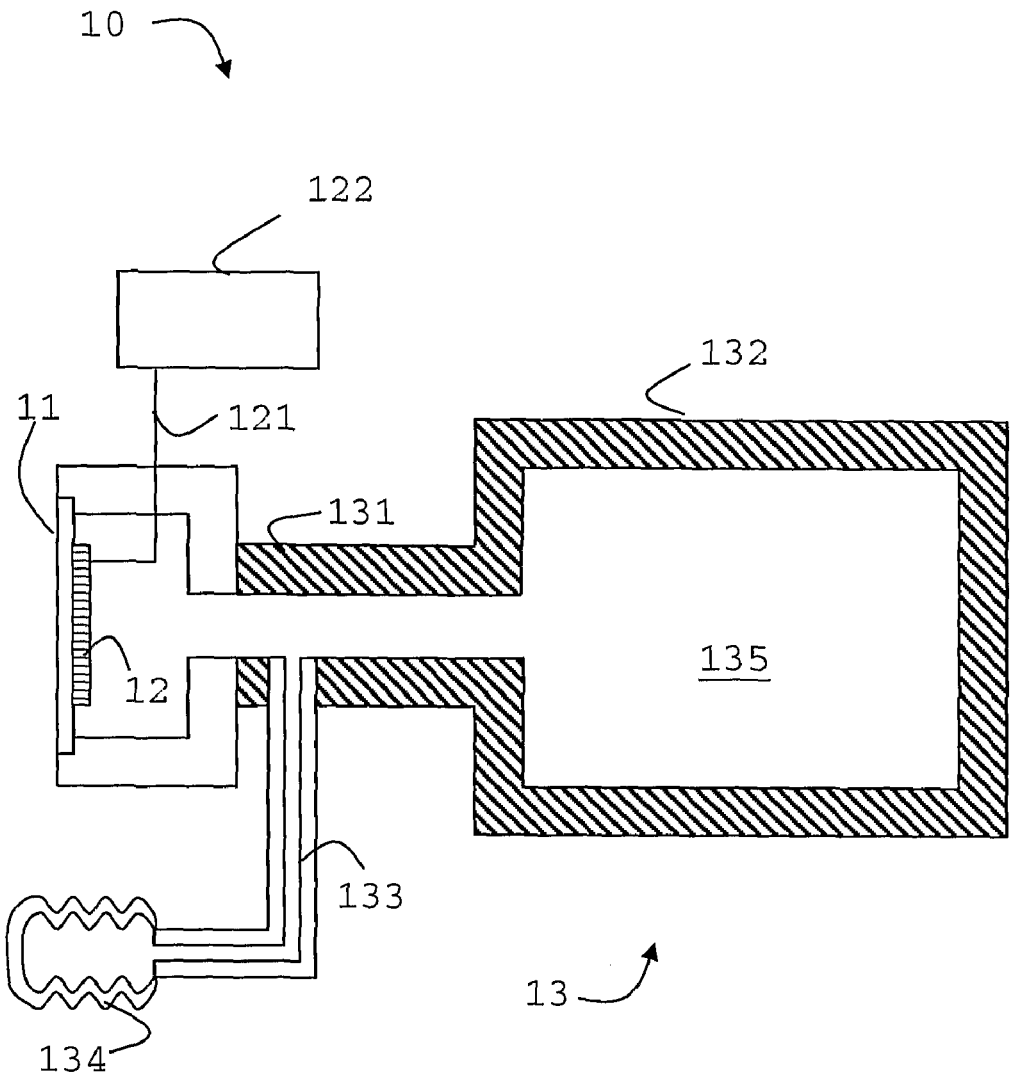
FIG. 1A illustrates elements of converter in accordance with an example of the invention.

In FIG. 1A there is shown a converter system 10 including a compliant pressure conversion structure 11, known also as a mechanical amplifier, an energy conversion device 12 that is connected via cable 121 to its driving or loading electronics 122, a mechanical/acoustic impedance matching means such as a Helmholtz resonator 13 including a connection tube 131 and a reservoir 132 and a reference pressure guide consisting of a capillary 133 and a bellow 134. These parts form an enclosed system filled with an inert filling fluid 135 inside. The pressure channel fluid, which is the carrier of the pressure wave is on outside of the system. In the example the pressure channel fluid is the fluid filling a wellbore (not shown)

The function of the pressure conversion structure or mechanical amplifier 11 is to convert the pressure wave of interest into a mechanical strain, and conversely, in the case of a source, to produce a strain that generates a pressure signal in the surrounding fluid. The structure 11 provides an isolation barrier between the pressure that surrounds its outer surface and the reference side which is the inner volume of the resonator 13. The structure 11 can have the form of a membrane or a capsule of various shapes—cylindrical, spherical, semi-spherical, etc. It has a mechanical stiffness that is defined by the range of the working pressure and the required strain.

For example, in FIG. 1, if the mechanical amplifier 11 is a thin flat membrane on one end of the cylindrical capsule as shown in FIG. 1A, a differential pressure across the membrane will cause it to move. The maximum displacement is achieved at the centre of the membrane. If a strain- or displacement-to-electricity converter 11, for instance a piezoelectric disc bender, is attached to the membrane, electrical energy generated from the strain can then be harvested by electronics unit 122, which is connected to the energy converter 12 through cable link 121.

Typically, the pressure conversion structure 11 should be made of a material with suitable mechanical properties, such as high strength and good elastic performances (e.g. low hysteresis). Good chemical resistance is also desirable. Suitable candidates may include stainless steel, Inconel, sapphire, etc.

Implementation of the strain- or displacement-to-electricity converter 12 may take various forms some of which will be described further below.

The inside of the system shown in FIG. 1A is filled with a fluid 135. In order to prevent the blockage of the capillary 133, the filling fluid 135 should be clean. Clean water or hydraulic oil such as silicone oil can be used. Oil based fluid has an advantage as an electrically insulating media if electrical, electromagnetic or electronics devices are to be installed inside the system. The bellow 134 provides a pressure transparent physical barrier between the channel fluid and the filling fluid 135.

The overall acoustic impedance of the complete pressure-to-electrical power conversion system, or that of the electrical-to-acoustic power conversion system, is determined by the pressure-to-strain conversion structure 11, the transducer 12 and the matching impedance 13. Preferably, this overall acoustic impedance of the energy conversion system should match the acoustic impedance of the pressure wave transmission channel, in order to allow maximum energy transfer between them. In general the value of this impedance should be as close to the channel impedance as possible.

In the example of in FIG. 1A, however, the impedance of the reference side 13 is small as explained in more detail below and therefore the impedance match is done mainly through that of the structure 11 and that of the energy transducer 12.

The channel impedance is normally given by:

$$Z_c = \frac{\rho_c \cdot c_c}{A_c} \quad [1]$$

where $A_c$ is the cross-sectional area of the channel, $\rho_c$ and $c_c$ are the viscosity and sound velocity of the fluid in the channel. The acoustic impedance of the pressure to electrical energy conversion system is approximately defined by:

$$Z_x = R + \frac{k_v}{j\omega} \quad [2]$$

where R is the equivalent acoustic resistance of the transducer 12, ω is the angular frequency and $k_v$ (in Pa/m$^3$) is the volumetric stiffness defined by the pressure needed for a unit volume change of the structure 11. For an energy harvesting system, R is closely related to the electrical energy that is taken away from the transducer by an energy harvesting electronic circuit. For an acoustic source, R is related to the internal electrical resistance of the transducer and its driving electronics circuit. For the case of a membrane as in FIG. 1A whose stiffness, $k_1$, is sometimes defined as force needed for a unit displacement, the following relationship holds:

$$k_1 = k_v \cdot A_2 \text{ (N/m)} \quad [3]$$

where A is the area of the membrane 11. To match the impedance to that of the channel, we should have:

$$R + \frac{k_1}{j\omega \cdot A^2} = Z_c. \quad [4]$$

The channel impedance is typically a real valued one. To achieve the impedance match, the imaginary term in Eq. 4 needs to be made much smaller than the real term, R, whose value should ideally approach that of $Z_c$. According to Eq. 4, if the operating frequency, ω, and channel impedance, $Z_c$, are known, one can then choose A and $k_1$ in the structure design to reduce the stiffness of the pressure to strain conversion structure, thus making the imaginary term much smaller than $Z_c$.

It is another aspect of the invention to pressure balance the reference side 13 of the system 10 with the outside pressure channel. The methods and devices described herein have two basic aims. The first is to achieve steady state or static pressure equalization, i.e. zero or minimal pressure difference at zero frequency or very low frequencies, between the pressure side and the reference side of the converter structure 11. The second is to create a mechanical/acoustic impedance at the reference side of the converter, which, in conjunction with the stiffness of the structure, provides appropriate impedance matching, within the operating frequency range, to the fluid filled pressure wave channel.

Typically, the pressure balance system consists of a reference pressure guide and a matching impedance that acts as an acoustic load to the pressure conversion structure.

The reference guide has an acoustic impedance value that is typically much higher than that of the pressure wave channel, Zc, which is determined by the cross-section of the channel as well as density and sound velocity of the fluid in the channel. The matching impedance, on the other hand, is typically much smaller than that of the channel. The reference guide and the matching impedance together, form an acoustic or pressure wave filter to the channel pressure, P. Depending on the type of the matching impedance, this can be either a low-pass filter or a band-stop filter.

For the embodiment shown in FIG. 1A, the reference guide is basically the capillary 133, whose impedance is shown by the following approximate expression:

$$Z_1 = \frac{L}{A} \cdot \left( \frac{\sqrt{2 \cdot \rho \cdot \mu \cdot \omega}}{r} + j\omega \cdot \rho \right) \quad [5]$$

where L, A, and r are the length, cross-sectional area and equivalent radius of the capillary, (A is a function of r), ρ and μ the density and viscosity of the fluid in the capillary, j is the square root of −1 and ω the angular frequency. The real part of this complex impedance represents a thermoviscous resistance and the imaginary part an inertance related to the mass in the capillary. Obviously the absolute value of the impedance can be increased conveniently by increasing L or reducing r (and hence A).

In FIG. 1A, the matching impedance is a Helmholtz resonator 13 including the connection tube 131 and the reservoir 132. The resonance frequency of the resonator can be selected by choosing the appropriate dimensions for the connection tube and the reservoir. Typically, the resonance frequency is chosen to match the working frequency of the pressure wave. The impedance of the resonator is approximately given by:

$$Z_h = \frac{L_t}{A_t} \cdot \frac{\sqrt{2 \cdot \rho \cdot \mu \cdot \omega}}{r_t} + j \cdot \left( \omega \cdot \rho \cdot \frac{L_t}{A_t} - \frac{\rho \cdot c^2}{\omega \cdot V_h} \right) \quad [6]$$

where $L_t$, $A_t$, and $r_t$ are the length, cross-sectional area and equivalent radius of the connection tube, c is the velocity of sound in the resonator fluid and $V_h$ the reservoir volume. Eq. 6 is similar to the expression for a R-L-C series resonance electrical circuit.

At the resonance frequency, the impedance value of the resonator reaches a minimum whereas that of the reference pressure capillary (Eq. 5) remains very large. The two impedances together form a band-stop filter whose typical frequency response is shown in 1B, for an 18 Hz Helmholtz resonator.

Numerical simulations of the system have been carried out by using a 1D planar wave linear model. Rigid system boundaries are assumed except at the membrane 11 and at the bellow 134, which is pressure transparent (zero stiffness). The liquid in the pressure wave channel (outside the conversion system) is assumed to be water (density 1000 kg/m$^3$, sound velocity 1500 m/s). The channel cross-section is assumed to be circular and the radius is chosen arbitrarily to be 15 mm. The radius of the membrane 11 is chosen to be the same (15 mm). The stiffness of the membrane 11 is chosen to be $k_1 = 10^5$ (N/m) for the conditions given above. The pressure in the wave channel is assumed to be 14.5 psi (1 bar), which is applied onto the membrane 11 and the bellow 134. The continuity of pressure and volume velocity is observed everywhere in the system. It is assumed that the inside of the system 13 is filled with silicone oil 135 of density 900 kg/m$^3$, sound velocity 1000 m/s and viscosity 10 cP.

Figure 1B:
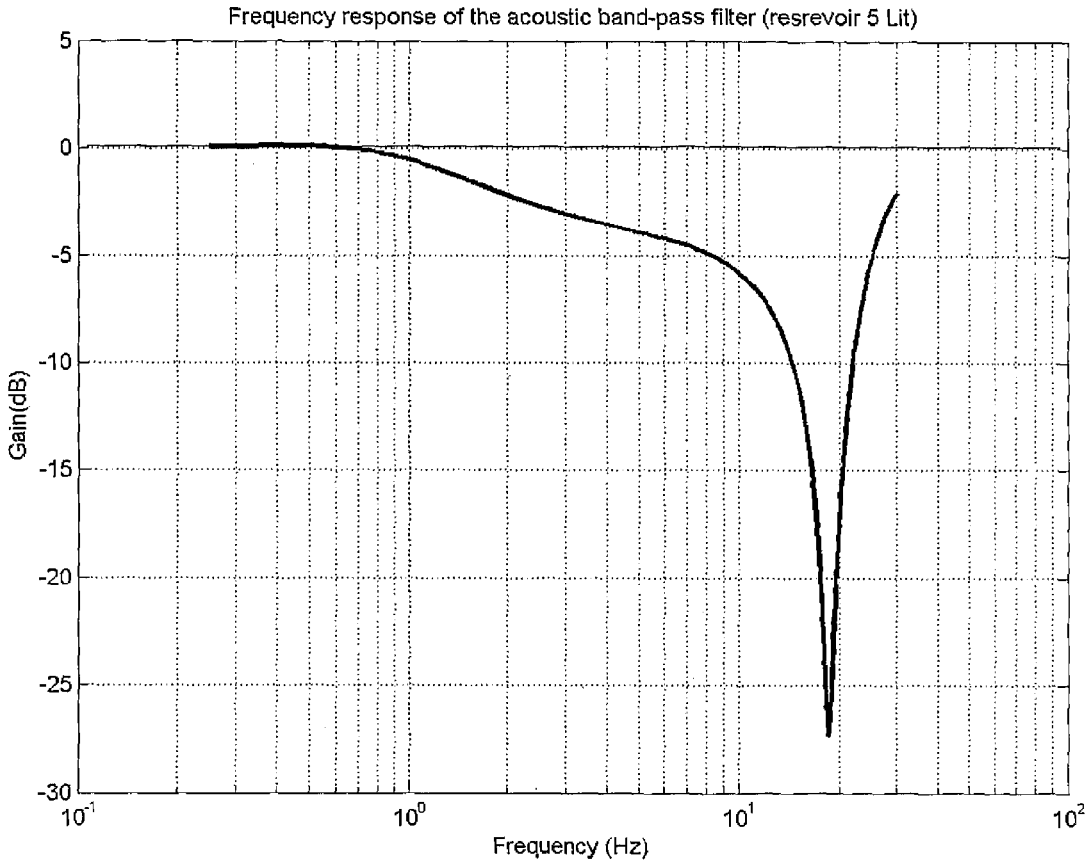
FIGS. 1B and 1C show properties of the example of FIG. 1A.

FIG. 1B shows the frequency response of the system of FIG. 1A, which is the ratio of the reference pressure inside the pressure conversion structure to the channel pressure outside it, plotted against frequency. This is the response of an equivalent acoustic filter that is formed by a capillary tube 133 of 2 m long and 1 mm diameter, and an 18 Hz Helmholtz resonator 13 consisting of a connection tube 131 of 1 m by 10 mm (length by diameter) and a 5 liter reservoir 132. The stiffness of the pressure conversion membrane 11 is set to $10^5$ N/m for the purpose of demonstrating the principle of the system. In the figure, the 0 dB gain at the low frequencies means that the near steady-state pressure in the channel is passed without attenuation to the reference side of the conversion structure. Around the selected operating frequency, 18 Hz, the channel pressure is attenuated significantly before reaching the reference side of the structure. Therefore the differential pressure applied across the structure is close to the dynamic pressure in the channel, at these frequencies.

Figure 1C:
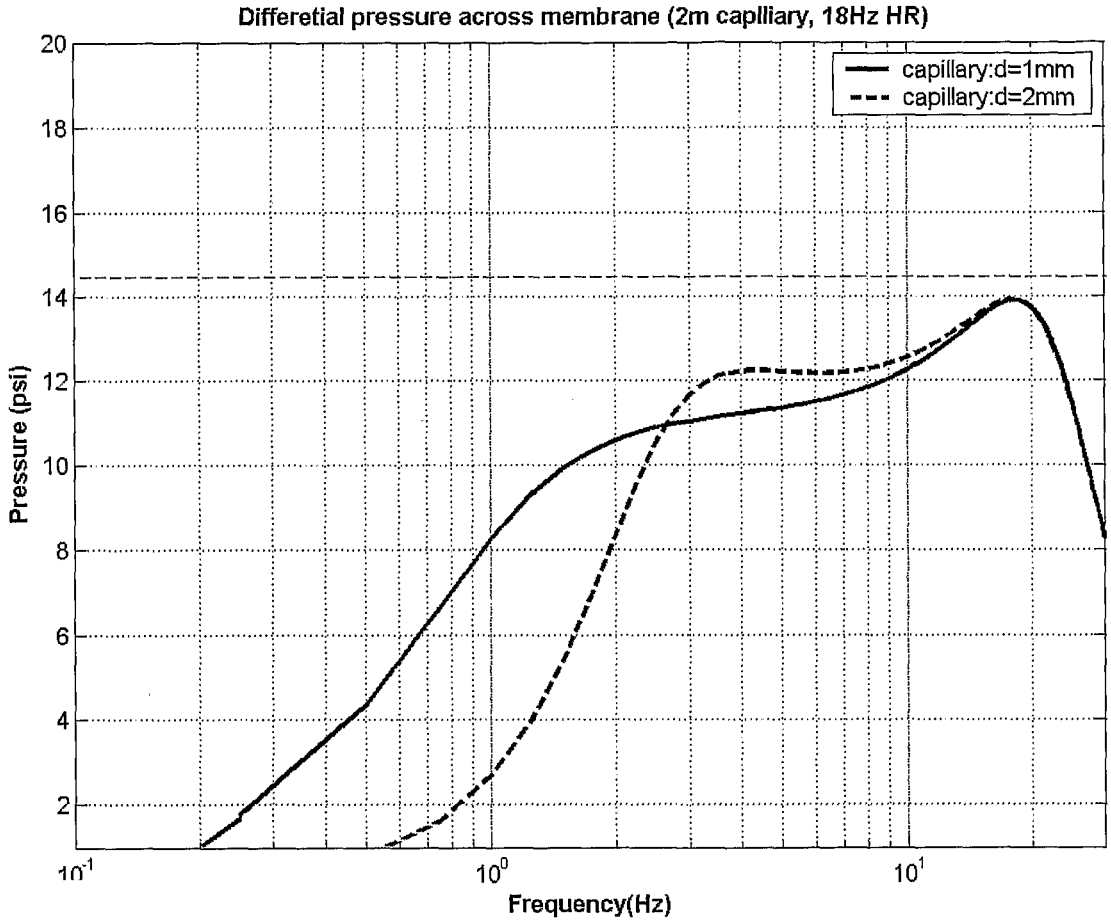

In FIG. 1C there are shown plots of the differential pressure across the membrane 11 versus frequency for the system 10 shown in FIG. 1A. The geometries and parameters used in the simulation are the same as those used in producing the plot of FIG. 1B, except two capillary diameters, 1 mm and 2 mm, are used to generate the solid and dashed curve, respectively.

For the 1 mm capillary, the frequency response of the capillary-Helmholtz filter is identical to that shown by FIG. 1B. FIG. 1C shows that the differential pressure tends towards zero at low frequencies, thus indicating that the pressure on both side of the membrane is equalized. The differential pressure rises towards the applied pressure wave amplitude of 14.5 psi as the frequency increases and reaches a maximum at the resonance frequency of around 18 Hz.

As shown one can obtain a significant differential pressure amplitude (here: above 12 psi) over a wide frequency range from about 10 Hertz to over 25 Hz. This means that the operational bandwidth of the system is wide and some degree of mismatch between the frequency of the pressure wave and that of the resonator can be tolerated.

The effect of capillary diameter is shown by the difference between the solid line (1 mm) and the dashed line (2 mm). The significance is shown only in the low frequency region where a capillary of a smaller diameter produces a low-pass filter of narrower pass band, leading to pressure equalization (zero differential pressure) only at frequencies further close to zero.

In FIG. 1A, the capillary 133 and the resonator 13 form a filter that filters out the pressure wave energy at the operating (working) frequency while passing the background or steady state pressure to the reference side. As a result, the two sides of the pressure conversion structure are balanced around zero frequency. At the operating frequency, $\omega_o$ (here: 18 Hz) the structure 11 is not balanced dynamically and the differential pressure applied on the structure equals almost fully the pressure wave amplitude because the pressure wave in the channel is prevented from reaching the reference side by the filter. Since the impedance at the reference side of the conversion structure 11 is small at frequencies around $\omega_0$, the structure can move easily in response to the differential pressure, thus producing a significant strain.

Figure 2A:
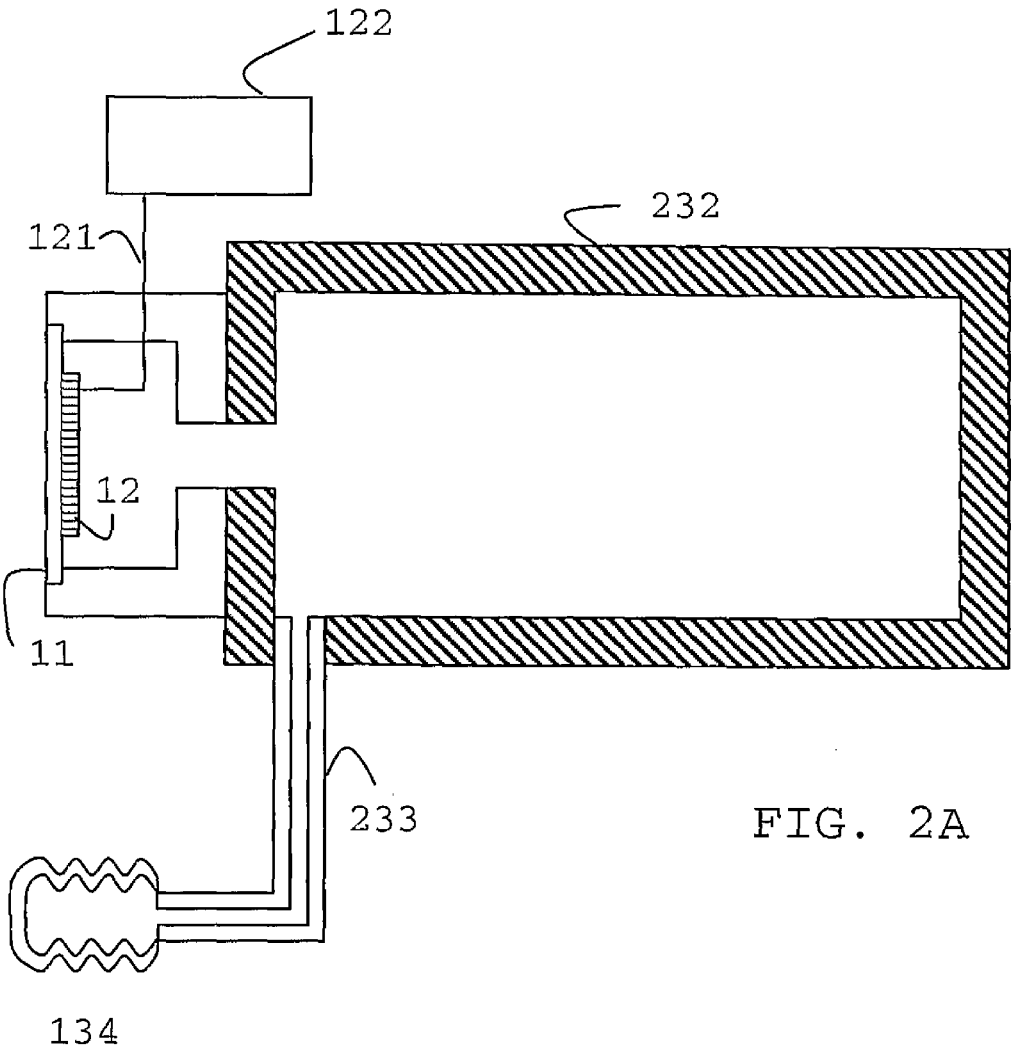
FIG. 2A illustrates elements of converter in accordance with another examples of the invention.

In another embodiment of the system, as shown in FIG. 2A, the matching impedance consists mainly of a reservoir 232, whose impedance decreases as the frequency increases. The volume of the reservoir 232 is determined according to the required impedance value at the specified operating frequency. Typically a sufficiently large volume is needed to achieve a sufficiently low impedance value.

The reference pressure guide again take the form of a long capillary tube 233 connected directly to the reservoir 232. This configuration forms a low-pass filter for the pressure in the outside pressure wave channel. The remaining elements of FIG. 1B insofar as they are similar to those of FIG. 1A carry the same numerals.

Figure 2B:
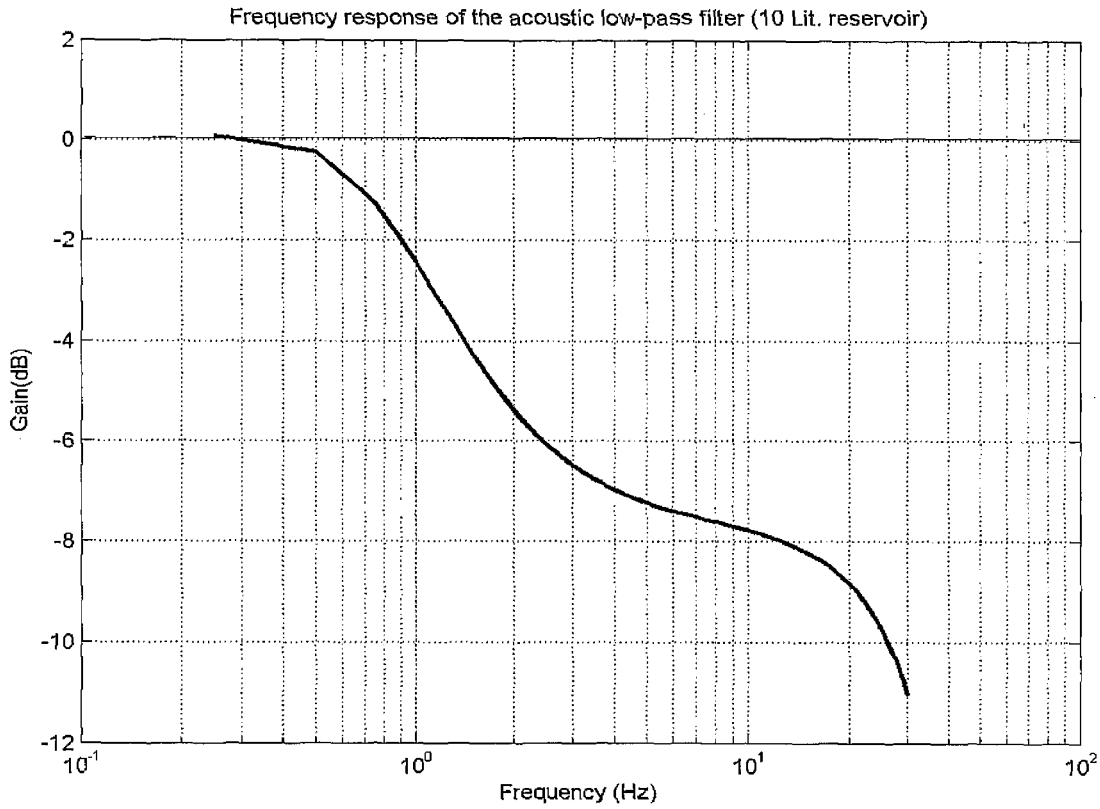
FIG. 2B shows properties of the example of FIG. 2A.

The typical frequency response of the filter which includes the capillary tube 233 and the reservoir 232 is shown in FIG. 2B for a 10 liter reservoir and a 2 meter capillary of 1 mm diameter.

Thus FIG. 2B shows the simulated frequency response of an acoustic low-pass filter as in the system shown by FIG. 2A. This is formed by a capillary tube of 2 m long and 1 mm diameter, and a 10-liter reservoir. The connection passage between the reservoir 232 and the pressure conversion structure 11 is short and wide so that its impedance is insignificant.

Again the stiffness of the pressure conversion membrane 11 is set to $10^5$ N/m for the simulation. The response shown in FIG. 2B is that of a low-pass filter, with no attenuation to channel pressure at near zero frequencies and increasing attenuation as the frequency increases.

The steady state pressure is introduced via the capillary 233 and the reservoir 232 to the reference side of the pressure conversion structure 11 whereas the dynamic pressure change is attenuated through this capillary-reservoir combination. Therefore the structure is unbalanced at higher frequencies, and sensitivity to dynamic pressure change is achieved.

Various implementation of the capillary can be used including various hydraulic tubes, holes and tunnels formed inside the walls of the system parts shown in FIGS. 1A and 2A. Appropriate length and diameter of the capillary are optimized to produce the required filter frequency response while minimizing the risk of blockage. The cut-off frequency of the filter should not be too close to zero, in order to avoid structure damage by slow varying and large amplitude pressure surge.

As demonstrated by the above equations, the dimensions for the parts shown in the figures largely depend on the specified operating frequency.

For pressure wave powered electricity generators, as mentioned in WO 2005/024177 A1, incorporated herein by reference, the operating frequency is in the range of a few tens of Hertz and therefore the reservoir volume may be in the region of a few liters and the capillary length in the order of a few meters. For downhole wireless smart sensors, as described in the introduction, the operating frequency could be close to 1 kilohertz, and the required corresponding dimensions would be greatly reduced.

It should be noted that the structures shown in the figures are not limited to cylindrical shaped cross sections. They can take different 3D shapes as long as they produce the appropriate mechanical/acoustic impedances at the relevant frequencies. For instance for downhole applications the systems described in this disclosure can be constructed around the outside of a production tubing, thus the cross-section of the system shown in FIG. 1A would appear as annular shaped.

Figure 3A:
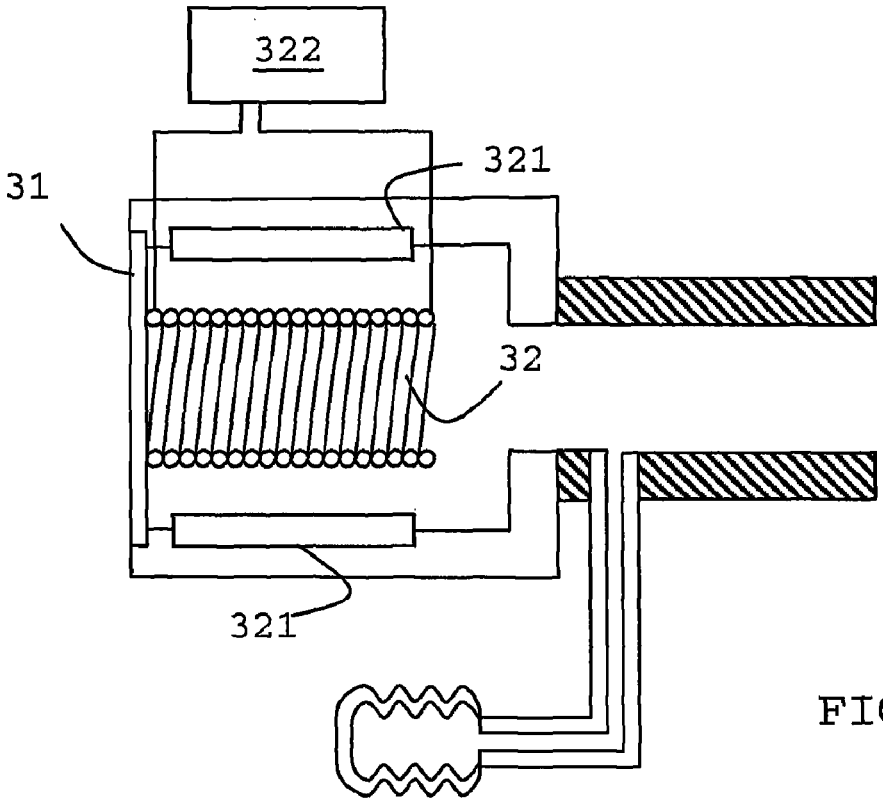
FIGS. 3A-3D illustrate further variants of converters in accordance with examples of the present invention.

As mentioned above, the exact implementation of the strain- or displacement-to-electricity converter may take various forms. For instance in FIG. 3A a moving wire coil 32 is attached to the strain generating structure 31, i.e. a membrane. Pressure induced displacement of the membrane 31 causes the coil 32 to move in a magnetic field that is provided by the magnets 321, mounted on the non-moving part of the structure 31. This relative movement between the coil 32 and the magnets 321 generates an induction current that can be harvested by the electronics unit 322.

Alternatively, one may attach a moving magnet to the membrane instead of a coil and mount the coil on the non-moving part of the structure. The relative movement between the magnet and the coil will generate an induction current, same as in FIG. 3A.

As another embodiment of the invention, one may use a structure built primarily with a special material, which serves both as the pressure to strain/displacement converter and as the mechanical to electrical energy converter. As shown in the example of FIGS. 3B-D, a structure with appropriate mechanical compliance can be made of a "smart" material, such as piezoelectric, electrostrictive or magnetostrictive materials.

Figure 3B:
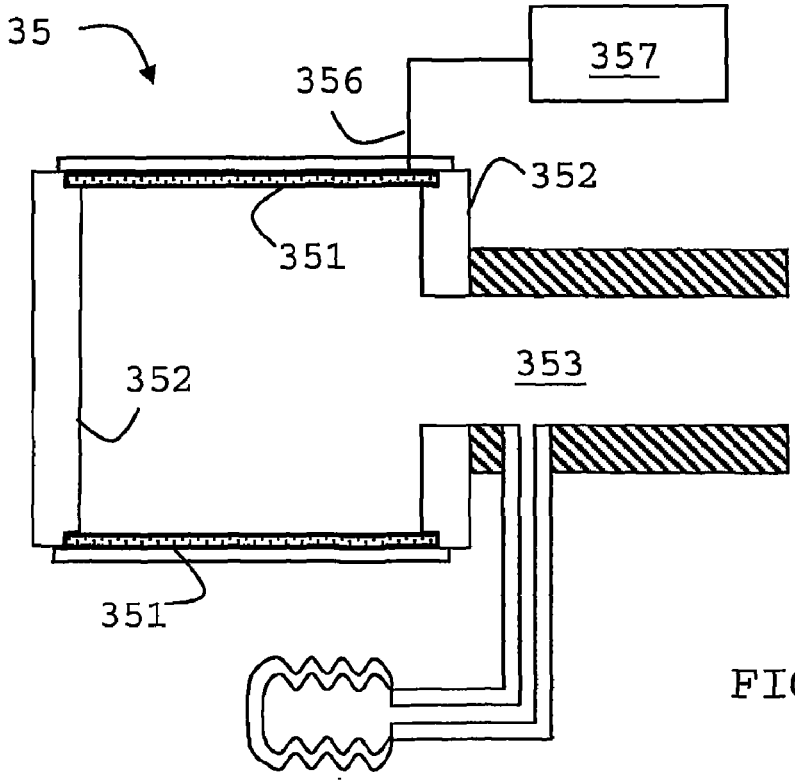
Figure 3C:
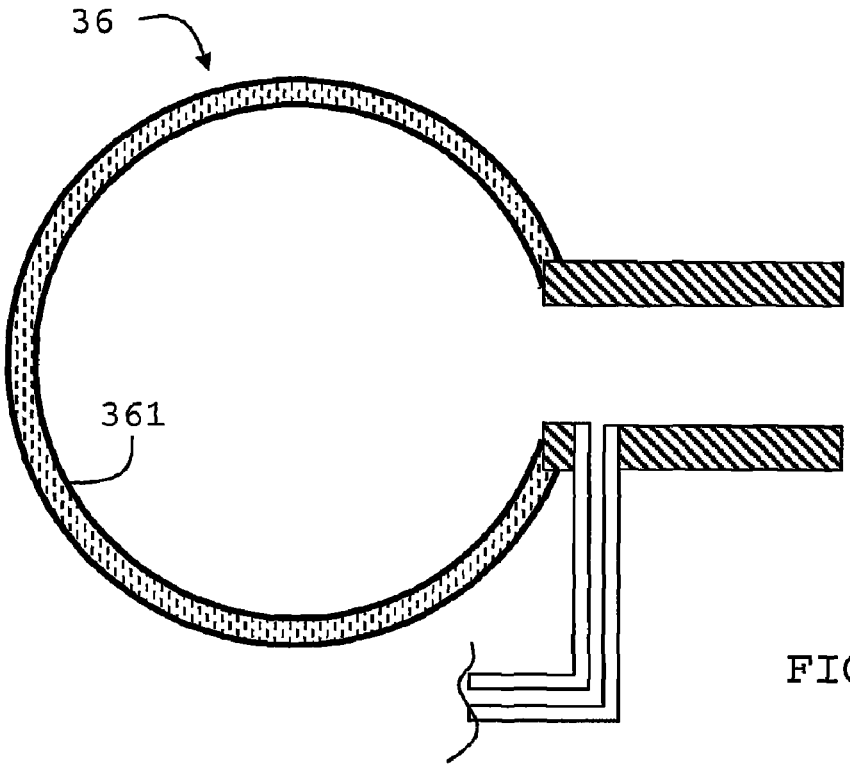
Figure 3D:
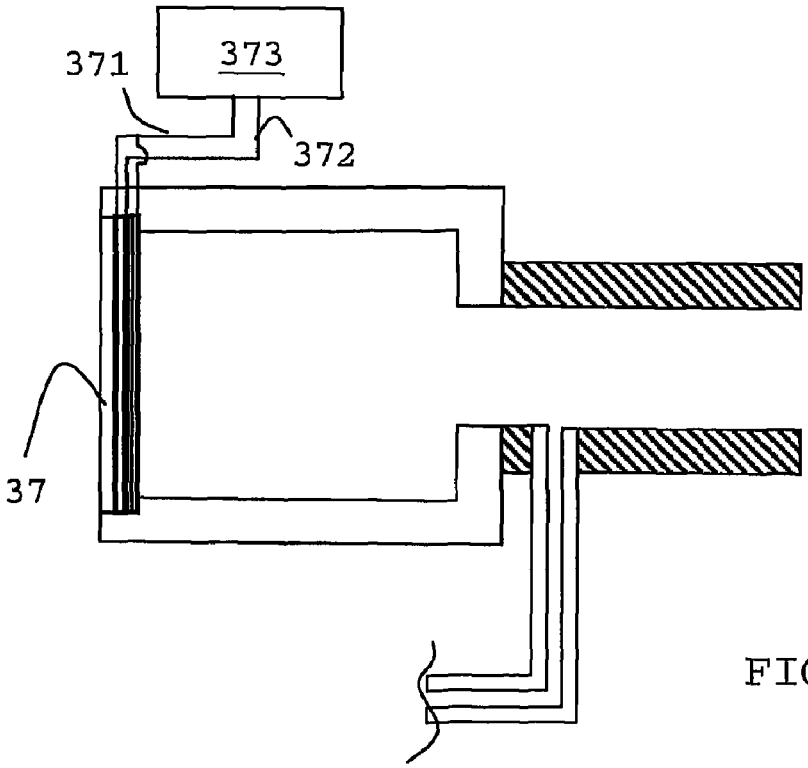

In FIG. 3B, the wall 351 of cylindrical tube 35 with appropriate wall thickness is made of a piezoelectric material, sandwiched between two coated metal electrodes. Additional protective coatings can also be used over the electrodes to prevent corrosion. The tube can be mounted between two non-compliant end pieces 352, thus forming an enclosure structure which separates the pressure wave channel from the reference side 353.

Under a differential pressure between inside and outside of the structure 35, the tube produces a strain in the radial, and hence also the circumferential, direction. For the active material in the tube wall, the stress and strain is predominately in the circumferential direction. Such a strain generates an electrical field in the thickness direction of the wall across the electrodes. Given the piezoelectric constant, $g_{31}$, of the material, one has:

$$E=g_{31}T \quad [7]$$

where T is the stress in the circumferential direction, denoted by index 1 and E the electric field generated in the thickness direction, denoted by index 3. The charge stored between the two electrodes can be harvested through the wire connections 356 and control circuits 357.

In FIG. 3C, a sphere structure 36 with appropriate wall thickness is shown. The wall 361 of the sphere 36 is made primarily of piezoelectric material, sandwiched between two metal electrodes. Extra protective coating may also be used. The working principle is similar to that shown in FIG. 3B.

It should be noted that the structure in the above examples can be a multi-layered one, with multiple thin tube 351 or sphere layers 361 stacked together in the radial direction. The electrodes of each layer can be connected in parallel or in series with those of other layers.

In FIG. 3D, a multilayer piezoelectric disc bender covered by a protective coating is used as the membrane 37. The piezoelectric material layers, two of which are shown have the opposite polarities. The two outer electrodes are electrically connected together by connection 372, whereas the central electrode provides the other electrical connection 371 to the harvesting circuit 373. With this configuration, the two layers are connected like parallel capacitors.

In general, the electrodes of each disc layer can be connected to those of other layers in either parallel or series according to the required mechanical compliance and electrical impedance.

The structures shown in FIGS. 1A, 2A and 3 can also be used as pressure wave generator by applying a driving electrical energy to the electrodes or the electrical connections. A mechanical strain will be produced, generating a pressure change in the outside pressure wave channel surrounding the structure.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

The invention claimed is:

1. A pressure-balanced electromechanical converter including a structure that converts displacement into electrical energy or electrical energy into displacement, said structure designed to separate an enclosed volume from an outside pressure wave channel, wherein said enclosed volume has a filtering, pressure transparent connection to said outside pressure wave channel with said filtering connection being pressure transparent to static pressure or low frequency pressure waves and attenuating pressure waves at higher frequencies and wherein at least part of the enclosed volume forms a Helmholtz resonator for the higher frequencies.

2. The converter of claim 1 wherein the filtering, pressure transparent connection acts as a low-pass filter or band-stop filter.

3. The converter of claim 1 wherein the filtering, pressure transparent connection is tuned to prevent pressure at a predetermined frequency from pressurizing the enclosed volume.

4. The converter of claim 1, wherein the filtering, pressure transparent connection comprises a capillary tube connecting said reservoir to the pressure wave channel.

5. The converter of claim 1, wherein the filtering, pressure transparent connection prevents exchange of fluids between the pressure wave channel and the enclosed volume.

6. The converter of claim 1, wherein the converting structure includes piezoelectric, electrorestrictive or magnetorestrictive materials.

7. The converter of claim 1, wherein the converting structure includes a membrane attached to an electromagnetic transducer.

8. The converter of claim 1, wherein the pressure waves at higher frequencies transmit signals or energy for conversion into electrical energy through the pressure wave channel.

9. The converter of claim 1, wherein the stiffness of the converting structure and an equivalent resistance of the mechanical-to-electrical or electrical-to-mechanical transducer are determined to achieve impedance match between an effective acoustic impedance of the converter and the acoustic impedance of the pressure wave channel.

10. The converter of claim 1 wherein the filtering, pressure transparent connection comprises at least two elements each having an acoustic impedance with a first impedance element connecting the pressure wave channel pressure through a pressure transparent physical barrier, with a second impedance element, wherein said first and second impedance elements form an acoustic filter.

11. The converter of claim 10 wherein the impedance of the first impedance element is zero or near zero at frequencies around zero Hertz and it increases significantly as the frequency increases and the impedance of the second impedance element is significantly higher than that of the first impedance element at low frequencies around zero Hertz and decreases significantly as the frequency increases.

12. The converter of claim 10 wherein the first impedance element includes a capillary tube and the second impedance element includes the Helmholtz resonator.

* * * * *